United States Patent [19]

Wheatcroft

[11] Patent Number: 4,949,979

[45] Date of Patent: Aug. 21, 1990

[54] GAME TARGET AND PLAYING METHOD

[76] Inventor: Kim E. Wheatcroft, P.O. Box 20122, Wichita, Kans. 67208

[21] Appl. No.: 317,752

[22] Filed: Mar. 1, 1989

[51] Int. Cl.[5] ..... F41J 5/00; A63B 69/36

[52] U.S. Cl. ..... 273/389; 273/392; 273/181 F; 273/407

[58] Field of Search ..... 273/181 A–181 J, 273/182 R, 182 A, 176 R, 176 A, 176 B, 176 E, 176 F, 176 FA, 176 FB, 375, 378, 389, 407, 411, 392, 390, 391

[56] References Cited

U.S. PATENT DOCUMENTS

| | | | |
|---|---|---|---|
| 920,907 | 5/1909 | Bolton | 273/181 F |
| 2,936,179 | 5/1960 | Thurston | 273/182 R |
| 2,988,360 | 6/1961 | Lambiotte | 273/181 A |
| 3,195,898 | 7/1965 | Respini | 273/181 F |
| 3,197,208 | 7/1965 | Malsar | 273/181 F |
| 3,328,033 | 6/1967 | Hendry | 273/182 R |
| 3,540,734 | 11/1970 | Temple | 273/181 A |
| 4,244,569 | 1/1981 | Wong | 273/389 |
| 4,395,042 | 3/1982 | Boswell | 273/181 F |
| 4,511,146 | 4/1985 | Windall | 273/181 J |
| 4,750,744 | 6/1988 | Michalee | 273/181 A |

*Primary Examiner*—George J. Marlo
*Attorney, Agent, or Firm*—John W. Carpenter

[57] ABSTRACT

An apparatus for playing a game. The apparatus has a frame, a net secured to the frame, a pair of front legs secured to the frame, and a rear leg connected to the frame and to the back portion of the net. A target is pivotally secured to the frame. A method for playing a game with the apparatus wherein a disk is thrown at a target pivoted to the frame.

6 Claims, 3 Drawing Sheets

FIG. 1
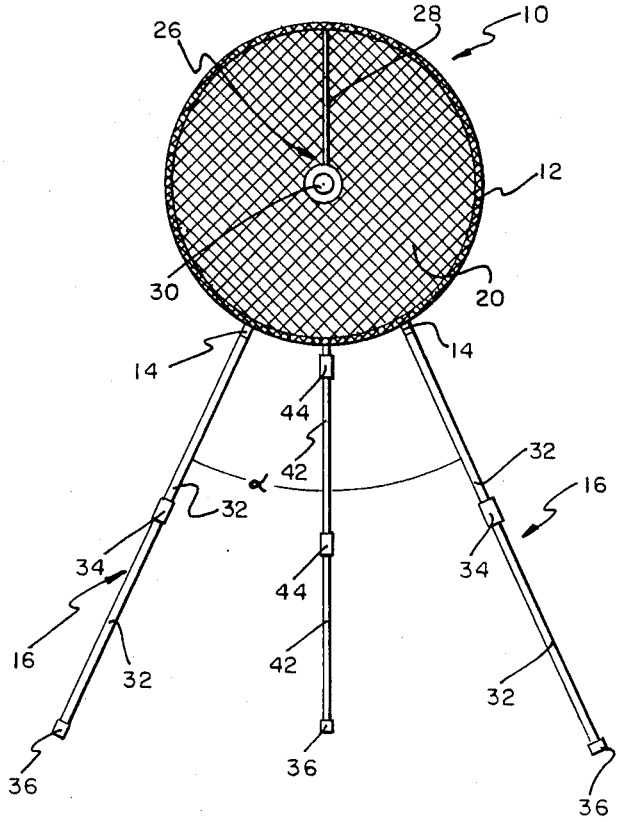
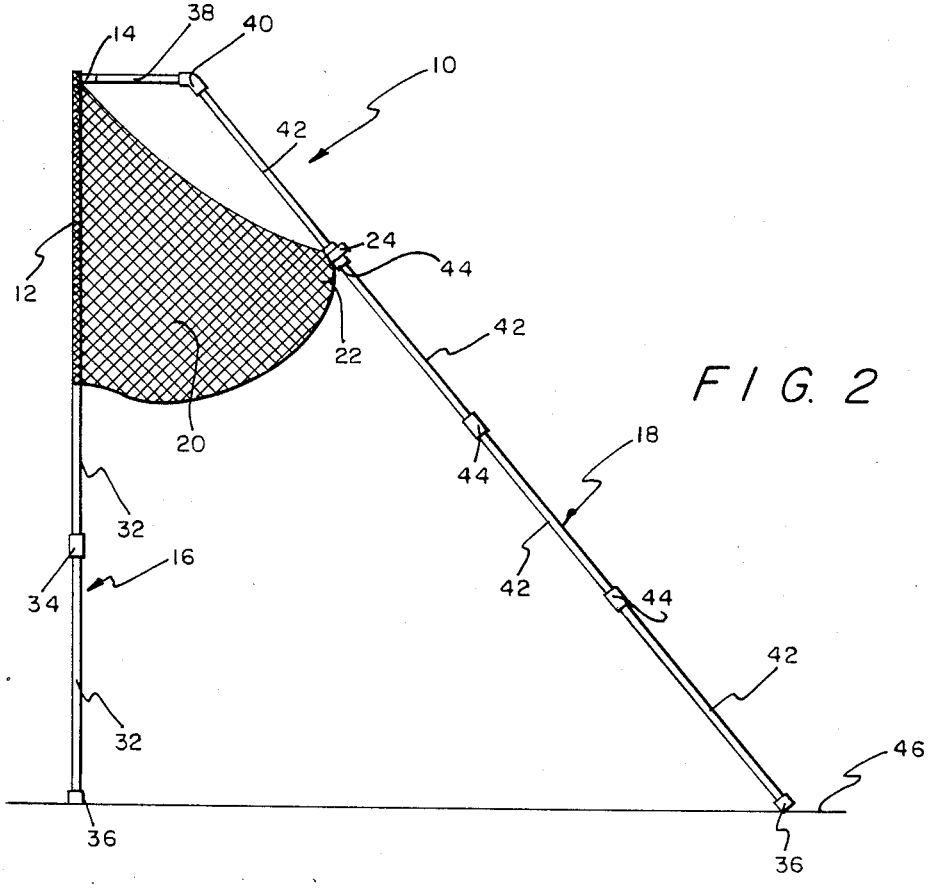
FIG. 2

GAME TARGET AND PLAYING METHOD

BACKGROUND OF THE INVENTION

1. Field of the Invention

This invention is related to a game. More specifically, this invention provides for an apparatus for playing a game where a flying disk, such as a Frisbee®, is thrown at a target pivotally disposed in front of a net, and a method for playing such a game.

2. Description of the Prior Art

A patentability investigation was conducted and the following U.S. patents were discovered: U.S. Pat. No. 920,907 to Bolton; U.S. Pat. No. 2,988,360 to Lambrotte; U.S. Pat. No. 3,195,898 to Respini; U.S. Pat. No. 3,197,208 to Makar; U.S. Pat. No. 4,395,042 to Boswell; U.S. Pat. No. 4,511,146 to Windall; and U.S. Pat. No. 4,750,744 to Michalec. None of the foregoing prior art U.S. patents teach or suggest the particular game and method of this invention.

SUMMARY OF THE INVENTION

The present invention broadly accomplishes its desired object by providing an apparatus for playing a game consisting of throwing a circular disk, such as those sold under the trademark FRISBEE®, into a net. The apparatus comprises a frame means for supporting a net means. A net means having a back net portion is secured to the frame means. A target means is pivotally secured to the frame means such that when a circular disk means comes into contact with the target means after being thrown, the target means pivots towards the net means to allow the circular disk means to land and lodge in the net means. The apparatus additionally comprises a pair of front leg means secured to the frame means for supporting the frame means in an elevated posture; and a rear leg means also secured to the frame means and extending away from the frame means towards the back net portion for supporting the frame means in an elevated posture along with the pair of front leg means. A disk means is included to provide an object to be thrown at the target means. The disk means is preferably of the type being circular with a projecting downwardly, flanged perimeter sold under the trademark FRISBEE®.

The present invention further broadly accomplishes its desired objects by providing a method for playing a game consisting of throwing a circular disk into a net, said method comprising the steps of:

(a) providing an apparatus having a frame means, a net means secured to the frame means, a target means privotally secured to the frame means, a pair of front leg means secured to the frame means for supporting the frame means in an elevated position off the ground, and a rear leg means also secured to the frame means and extending away from the frame means and contacting the ground for also supporting the frame means in an elevated position along with the pair of front leg means;

(b) securing a back portion of the net means to the rear leg means; and (c) throwing a disk means towards the target means pivotally lodging to the frame means.

It is therefore an object of the present invention to provide an apparatus for playing a game.

It is another object of the present invention to provide a method for playing a game.

These, together with the various ancillary objects and features which will become apparent to those skilled in the art as the following description proceeds, are attained by this novel game apparatus and process, a preferred embodiment being shown with reference to the accompanying drawings, by way of example only, wherein:

BRIEF DESCRIPTION OF THE DRAWINGS

FIG. 1 is a front elevational view of one embodiment of the apparatus of this invention;

FIG. 2 is a side elevational view of the apparatus of FIG. 1;

DETAILED DESCRIPTION OF THE INVENTION

Figure 3:
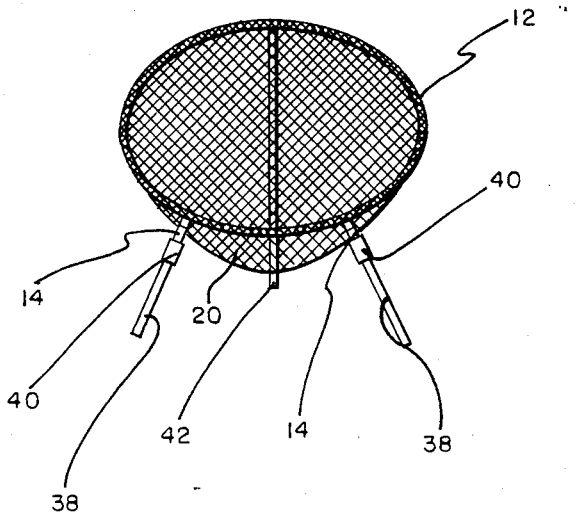
FIG. 3 is a front elevational view of another embodiment of the apparatus of this invention.

Referring in detail now to the drawings, wherein similar parts of the invention are identified by like reference numerals, there is seen in FIGS. 1 and 2 one embodiment of the apparatus of this invention, generally illustrated as 10. The apparatus 10 comprises a frame 12 with an opening which is preferably, but not necessarily, circular as illustrated. Secured to and along the perimeter of the frame 10 are lugs 14-14-14 protruding as illustrated. Snuggly engaged respectively to a pair of lugs 14-14 on the lower part of the frame 12 is a pair of front leg means, each generally illustrated as 16. The lugs 14-14 and their respective depending legs 16-16 support the frame 12 and are angularly disposed and separated by an angle $\alpha$ ranging from about 10° to about 120°, more preferably from about 20° to about 75°.

As best illustrated in FIG. 2, the third or remaining lug 14 protrudes toward the rear and away from the frame 12 on the upper part thereof. Snuggly secured to this third or remaining lug 14 is a rear leg means generally illustrated as 18 and extending away and down as illustrated to also support the frame 12 in an upright, elevated position along with the pair of front legs 16-16.

Figure 5:
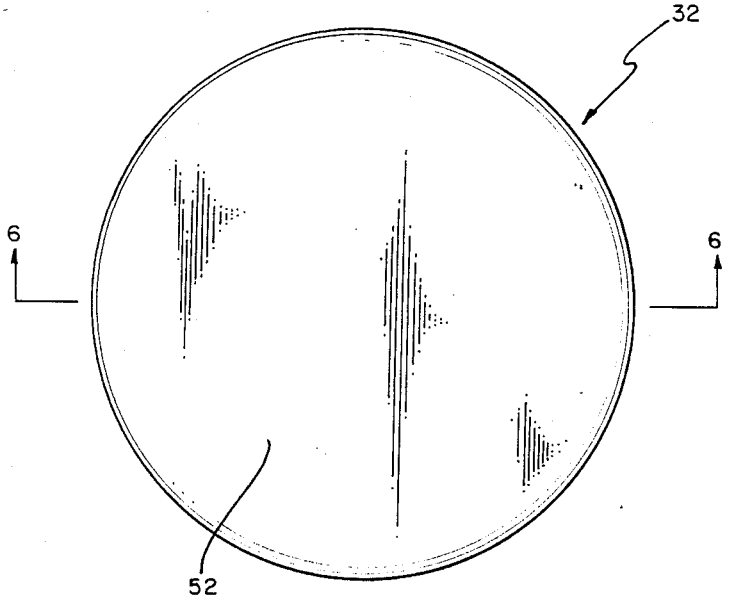
FIG. 5 is a top plan view of a disk means which is to be employed with the apparatus of FIGS. 1 and 2.
Figure 6:
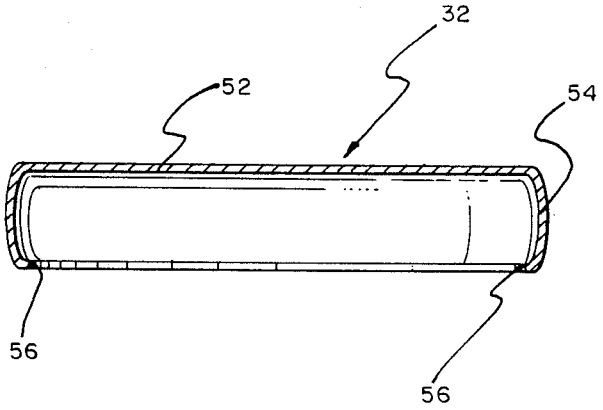
FIG. 6 is a vertical sectional view taken in direction of the arrow and along the plane of line 6—6 in FIG. 5.

Connected around and to the frame 12 is a net 20 having a rear or back net portion 22 which is preferably connected by a fastener means 24 to the rear leg 18. As best shown in FIGS. 1 and 2, net 20 is generally shaped conically with the back net portion 22 being the tapering or converging point or apex of the conical shaped net 20. Pivotally secured to the frame 12, preferably the top part thereof, is a target means, generally illustrated as 26. Target means 26 may be any suitable pivotally hanging target but is preferably of the type comprising a flexible line 28 secured pivotally and in a depending relationship to the top portion of the frame 12, and a target 30 connected to an end of the line 28. When a thrown object, such as a disk means generally illustrated as 32 in FIGS. 5 and 6, is thrown towards the target 30, upon hitting the target 30 it will pivot or swing towards the back net portion 22 or the rear leg 18, to allow the thrown object to continue traveling forward towards the back net portion 22 and the rear leg 18 for eventual landing and/or lodging in the net 20. As best shown in FIG. 2, when the frame 12 is supported by the front legs 16—16 and the rear leg 18 in the upright, elevated position, the opening of the frame 12 defines a plane that is generally vertical with respect to the ground 46 or other support surface. Stated alternatively, a plane across the face of the frame 12 will be generally perpendicular or vertical with the ground 46 or other support surface.

Each of the front legs 16 comprise a pair of tubular front members 32-32 interconnected by a coupling or connector 34. Preferably secured to each of the lower tubular front members 32 is a rubber tip means 36 to protect the insides of the tubular members 32 from accumulating dirt and the like from the ground 46. As best illustrated in FIG. 1, the upper tubular front members 32 respectively secure to the legs 14-14.

The rear leg 18 comprises a top tubular member 38 for engaging the third leg 14. At an end of the top tubular member 38 is a 45° elbow member 40 to which the remaining structural portion of the rear leg 18 connects in the form of a plurality of tubular rear members 42 interconnected by a coupling or connector 44. At the end of the lowest most tubular rear member 42 is the rubber tip means 36 which also functions to keep the insides of the tubular rear members 42 clean and dirt-free when the apparatus 10 is supported by the ground 46.

The fastener means 24 is preferably secured to one of the connectors 44 or one of the tubular rear members 42 after passing through the net 20. Fastener means 24 may be any suitable fastener but is preferably of the type marketed under the registered trademark VELCRO® brand hook and loop fasteners by Velcro Corporation, In VELCRO® brand hook and loop fasteners, a surface defined by the hooks is merely placed into face-to-face relationship with a surface defined by the loops so that a large number of hooks engage a large number of loops and therefore are able to resist separation by forces parallel to the interfacial plane of engagement but are readily separable by peeling forces applied substantially normal to this interfacial plane. While the fastener means 24 is preferably a VELCRO® type fastener means, it should be understood that any type of receiver, gripping or fastener means is contemplated within the spirit and scope of this invention. For example, any flexible engaging elements including mushroom-like elements, resilient projections, etc., which are readily securable in face-to-face relation, and which particularly resist forces parallel to the interfacial plane of engagement, are contemplated within the spirit and scope of the present invention. Such mushroom configured hooking elements as the type disclosed in U.S. Pat. Nos. 3,138,841 and 3,320,649, both to Naimer, and U.S. Pat. Nos. 3,718,725 and 3,770,359 both to Hamano are contemplated. Further examples of knitted form fastener members contemplated within the scope of the present invention are disclosed in U.S. Pat. Nos. 3,530,687 and 3,539,436, both to Hamano.

Figure 4:
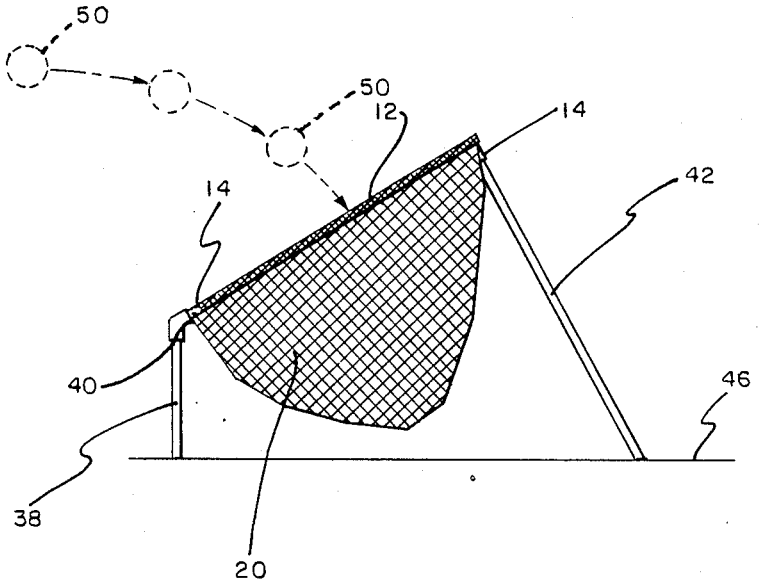
FIG. 4 is a side elevational view of the apparatus of FIG. 3.
Figure 7:
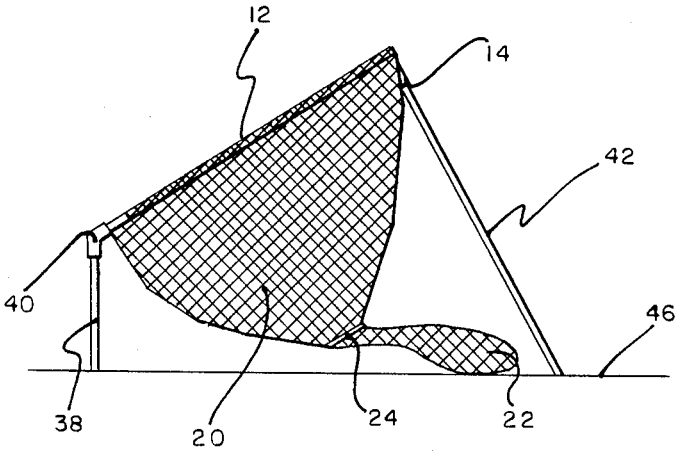
FIG. 7 is a side elevational view of another embodiment of the apparatus in FIG. 3.

Shown in FIGS. 3 and 4 is another embodiment of the apparatus of FIGS. 1 and 2 which is ideally suited for golf where a golf ball is pitched/chipped into the net 20. The apparatus in FIGS. 3 and 4 has the frame 12, the net (without the back net portion 22) connected to the frame 12, a pair of 45° elbow members 40-40 respectively fastened to the lugs 14-14, a pair of top tubular members 38-38 (see FIG. 2) respectively slidably engaged into the elbow members 40-40, and a tubular rear member 42 (from FIG. 2) slidably engaged to the third or rear leg 14. As illustrated in FIGS. 3 and 4, the frame 12 is angularly disposed with respect to the ground 46 such as to position the net 20 for readily receiving a pitch and chip shot of a golf ball 50 (shown in the drawings as dotted lines). In instances where the net 20 has the back net portion 22 as illustrated in FIG. 7, the fastener means 24 is to be employed to cut down the depth of the net 20. More particularly, by wrapping the fastener means 24 around the central postion of the net 20 for collapsing tautly the same, the depth of the net 24 is shortened or lessened. The bottom of the net 20 becomes the location where the fastener means 24 is wrapped around the central portion of the net 20. Such disposition of the fastener means 24 facilitates the removal of the golf ball 50 from the net 20 due to being readily exposed as opposed to being hidden in the back net portion 22.

The disk means 32 may be any suitable disk-like object which when thrown has the tendency to float smoothly through the air comparable to a "flying saucer". As was indicated, the preferred disk means 32 is of the type sold under the trademark FRISBEE® which comprises a circular disk roof 52, and a depending circular arcuate-face side 54 depending therefrom. Preferably, the arcuate-face side 54 terminates in an inwardly facing lip 56. When the disk means 32 of FIGS. 5 and 6 is thrown with the disk roof 52 faced upwardly, the disk means 32 floats through the air with the disk roof 52 remaining facing upwardly and with the disk means 32 spinning/revolving about its central axis. When the disk means 32 is thrown towards the target 30 that is hanging in front of the net 20, the disk means 32 can land in the net 20 (if thrown accurately) without hitting the target 30; or the disk means 32 can hit the target 30 (if thrown more accurately) and cause the latter to pivot towards the rear leg 18 and the back net portion 22, with the disk means 32 continuing forward to land in the net 20, more particularly the back net portion 22. Obviously, for the purpose of a game, points can be allocated for hitting the target 30 and for landing in the net 20 without hitting the target 30. By the back net portion 22 being secured to the rear leg 18, the disk means can be easily removed from the net 20. The pair of front legs 16-16 and the rear leg 18 form a tripod-like structure to support the net 20 and frame 12 in the posture of FIGS. 1 and 2.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. An apparatus for playing a game wherein a circular disk is thrown comprising a frame having an opening; a conical shaped net converging from said frame into a back net portion and secured to said frame for receiving a circular disk; a target privotally secured to said frame such that when a circular disk comes into contact with said target after being thrown, the target pivots towards the net to allow the circular disk to land in the net; a pair of front legs secured to said frame for supporting said frame in a substantially vertical, elevated plane on a support surface; and a rear leg secured to said frame and extending rearward from said frame towards the back net portion for supporting the frame in a substantially vertical, elevated plane on said support surface along with the pair of front legs, said back net portion being secured to said rear leg; and when said frame is in a substantially vertical elevated plane, the opening of the frame defines a plane that is generally vertical with respect to the support surface.

2. The apparatus of claim 1 additionally comprising a disk for being thrown towards the target.

3. The apparatus of claim 2 additionally comprising a pair of lower lugs secured to the frame, an upper lug secured to the frame; and said pair of front legs being slidably engaged respectively to the pair of lower lugs; and said rear leg being slidably engaged to said upper lug.

4. The apparatus of claim 3 wherein said frame is circular, and said pair of front legs is angularly disposed from about 20° to about 75° apart on an arc of the circular frame.

5. The apparatus of claim 3 wherein said rear leg comprises a top tubular member engaged to said upper lug and generally parallel to a horizontal plane; a 45° elbow member engaged to said top tubular member; and a plurality of interconnected rear tubular members secured to said 45° elbow member.

6. A method for playing a game with the apparatus of claim 1 comprising the step of:

throwing a disk toward the target.

* * * * *